US009200502B2

(12) United States Patent
Moen

(10) Patent No.: US 9,200,502 B2
(45) Date of Patent: Dec. 1, 2015

(54) WELL-BASED FLUID COMMUNICATION CONTROL ASSEMBLY

(75) Inventor: Terje Moen, Sandnes (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 680 days.

(21) Appl. No.: 13/523,385

(22) Filed: Jun. 14, 2012

(65) Prior Publication Data

US 2012/0325500 A1 Dec. 27, 2012

Related U.S. Application Data

(60) Provisional application No. 61/500,117, filed on Jun. 22, 2011.

(51) Int. Cl.

| | |
|---|---|
| ***E21B 43/12*** | (2006.01) |
| ***E21B 43/14*** | (2006.01) |
| ***E21B 34/14*** | (2006.01) |
| *E21B 34/00* | (2006.01) |

(52) U.S. Cl.

CPC ..... *E21B 34/14* (2013.01); *E21B 43/12* (2013.01); *E21B 2034/007* (2013.01)

(58) Field of Classification Search

CPC ..... E21B 43/12; E21B 34/14

See application file for complete search history.

(56) References Cited

U.S. PATENT DOCUMENTS

| | | | | |
|---|---|---|---|---|
| 3,741,300 | A | 6/1973 | Wolff et al. | |
| 4,510,996 | A | 4/1985 | Hardin | |
| 5,332,038 | A | 7/1994 | Tapp et al. | |
| 5,337,808 | A | 8/1994 | Graham | |
| 5,513,703 | A | 5/1996 | Mills et al. | |
| 5,579,844 | A | 12/1996 | Rebardi et al. | |
| 5,609,204 | A | 3/1997 | Rebardi et al. | |
| 5,865,251 | A | 2/1999 | Rebardi et al. | |
| 5,896,928 | A | 4/1999 | Coon | |
| 6,158,510 | A | 12/2000 | Bacon et al. | |
| 6,220,350 | B1 | 4/2001 | Brothers et al. | |
| 6,220,357 | B1 * | 4/2001 | Carmichael et al. | 166/321 |
| 6,405,800 | B1 | 6/2002 | Walker et al. | |
| 6,446,729 | B1 | 9/2002 | Bixenman et al. | |
| 6,464,006 | B2 | 10/2002 | Womble | |
| 6,622,794 | B2 | 9/2003 | Zisk, Jr. | |

(Continued)

FOREIGN PATENT DOCUMENTS

WO 2011017193 A2 2/2011

OTHER PUBLICATIONS

International Search Report and Written Opinion issued in PCT/US2012/043218 on Jan. 7, 2013, 10 pages.

*Primary Examiner* — Giovanna C Wright
(74) *Attorney, Agent, or Firm* — Patrick Traister

(57) ABSTRACT

An apparatus includes a base pipe, a screen and a first assembly. The screen at least partially circumscribes the base pipe to create a flow path between a first region that is outside of the screen and a second region that is inside the base pipe. The flow path includes at least one radial port of the base pipe and a third region between the screen and the exterior of the base pipe. The first assembly regulates fluid communication through the flow path. The first assembly includes a second assembly that is disposed in and mounted to the base pipe and a flow control device that is slidably connected to the second assembly. The flow control device is adapted to translate between at least two positions to regulate the fluid communication through the flow path.

25 Claims, 5 Drawing Sheets

(56) References Cited

U.S. PATENT DOCUMENTS

| | | | | |
|---|---|---|---|---|
| 6,644,412 | B2 | 11/2003 | Bode et al. | |
| 6,719,051 | B2 | 4/2004 | Hailey, Jr. et al. | |
| 6,786,285 | B2 | 9/2004 | Johnson et al. | |
| 6,883,613 | B2 | 4/2005 | Bode et al. | |
| 6,899,176 | B2 | 5/2005 | Hailey, Jr. et al. | |
| 6,938,698 | B2 | 9/2005 | Coronado | |
| 7,059,401 | B2 | 6/2006 | Bode et al. | |
| 7,096,945 | B2 | 8/2006 | Richards et al. | |
| 7,100,686 | B2 | 9/2006 | Wittrisch | |
| 7,191,833 | B2 * | 3/2007 | Richards | 166/278 |
| 7,828,067 | B2 | 11/2010 | Scott et al. | |
| 7,832,473 | B2 | 11/2010 | Pensgaard | |
| 8,011,432 | B2 | 9/2011 | Langlais et al. | |
| 8,104,535 | B2 | 1/2012 | Sierra et al. | |
| 2002/0108755 | A1 | 8/2002 | Zisk, Jr. | |
| 2002/0117301 | A1 | 8/2002 | Womble | |
| 2002/0157837 | A1 | 10/2002 | Bode et al. | |
| 2002/0189815 | A1 | 12/2002 | Johnson et al. | |
| 2003/0141060 | A1 | 7/2003 | Hailey, Jr. et al. | |
| 2003/0141061 | A1 | 7/2003 | Hailey, Jr. et al. | |
| 2004/0020832 | A1 | 2/2004 | Richards et al. | |
| 2004/0035578 | A1 * | 2/2004 | Ross et al. | 166/250.15 |
| 2004/0108107 | A1 | 6/2004 | Witrisch | |
| 2004/0134655 | A1 * | 7/2004 | Richards | 166/276 |
| 2008/0169099 | A1 | 7/2008 | Pensgaard | |
| 2008/0236843 | A1 | 10/2008 | Scott et al. | |
| 2009/0008078 | A1 * | 1/2009 | Patel | 166/50 |
| 2009/0056934 | A1 | 3/2009 | Xu | |
| 2009/0095471 | A1 | 4/2009 | Guignard et al. | |
| 2009/0101344 | A1 | 4/2009 | Crow et al. | |
| 2009/0101352 | A1 | 4/2009 | Coronado et al. | |
| 2011/0042083 | A1 | 2/2011 | Sierra et al. | |
| 2011/0067886 | A1 | 3/2011 | Moen | |
| 2011/0073308 | A1 | 3/2011 | Assal et al. | |

* cited by examiner

WELL-BASED FLUID COMMUNICATION CONTROL ASSEMBLY

This application claims the benefit under 35 U.S.C. §119 (e) to U.S. Provisional Patent Application Ser. No. 61/500,117 entitled, "INSIDE BASE PIPE SLIDING SLEEVE-ADAPTIVE ICD," which was filed on Jun. 22, 2011, and which is hereby incorporated by reference in its entirety.

BACKGROUND

For purposes of forming a well to extract a hydrocarbon-based fluid (oil or natural gas) from a hydrocarbon-bearing geological formation, a wellbore is first drilled into the formation and completion equipment, which includes a complex system of tubes and valves, is installed in the wellbore. The completion equipment may include sand control equipment, such as screens, fluid communication control valves, filtering media and a tubing string to communicate well fluid to the Earth surface (for production) or communicate fluid into the well (for injection). More specifically, the completion equipment may include screen assemblies, which may each include a screen, a base pipe and a fluid communication control device. In this manner, the base pipe may include radial ports, which permit communication between the inner passageway of the tubing string and the region outside of the screen, depending on the state of the fluid communication control device. In general, the fluid communication control device permits adjustment of the inflow (for production) or outflow (for injection), which accounts for unexpected reservoir flow performance as well as a reservoir flow performance that may change over time.

SUMMARY

In an example implementation, an apparatus includes a base pipe, a screen and a first assembly. The screen at least partially circumscribes the base pipe to create a flow path between a first region that is outside of the screen and a second region that is inside the base pipe. The flow path includes at least one radial port of the base pipe and a third region between the screen and the exterior of the base pipe. The first assembly regulates fluid communication through the flow path. The first assembly includes a second assembly that is disposed in and mounted to the base pipe and a flow control device that is slidably connected to the second assembly. The flow control device is adapted to translate between at least two positions to regulate the fluid communication through the flow path.

In another example implementation, a technique that is usable with a well includes inserting a fluid communication control interface into a central passageway of a base pipe of a screen assembly proximate to at least one radial port of the base pipe. The technique includes securing the fluid communication control interface to the base pipe and slidably mounting a sleeve to the interface to regulate fluid communication between the radial port(s) and the central passageway of the base pipe.

In yet another example implementation, a system that is usable with a well includes a tubing string to communicate fluid between an Earth surface and a downhole annular region. The tubing string includes at least one screen assembly, which includes a base pipe, a screen and a first assembly. The screen at least partially circumscribes the base pipe and is positioned downhole to create the annular region. The screen is adapted to create a flow path between the annular region and a second region inside the base pipe. The flow path includes at least one radial port of the base pipe and a third region between the screen and the exterior of the base pipe. The first assembly regulates fluid communication through the flow path and includes a second assembly and a sleeve. The screen assembly is disposed in and mounted to the base pipe, and the sleeve slidably connected to the second assembly. The sleeve is adapted to be translated by a tool, which is run downhole inside the tubing string between at least two positions to regulate the fluid communication through the flow path.

Advantages and other desired features will become apparent from the following drawings, description and claims.

DETAILED DESCRIPTION

Figure 1:
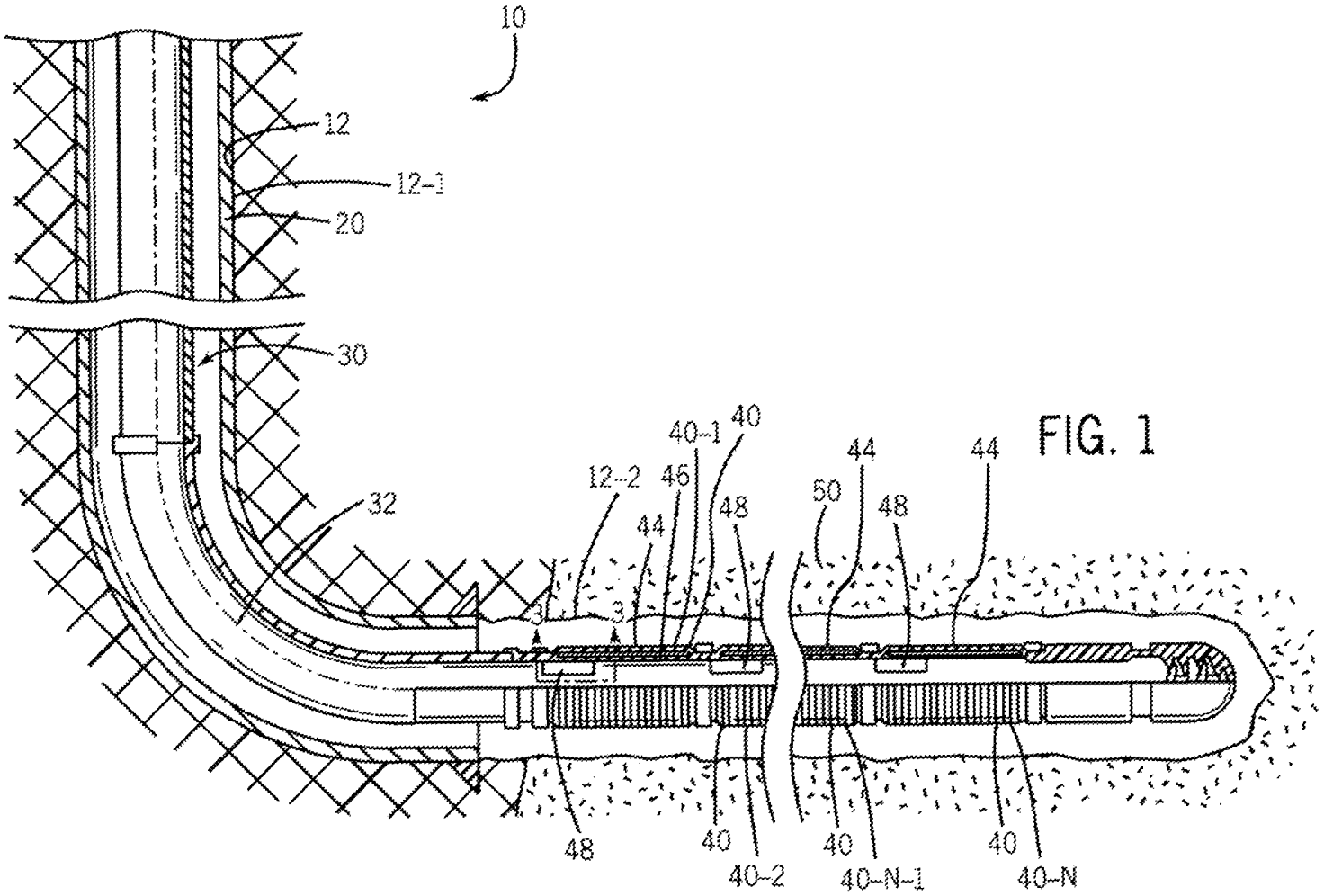
FIG. 1 is a schematic diagram of a well system that includes screen assemblies according to an example implementation.

In the following description, numerous details are set forth to provide an understanding of embodiments of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe implementations. Moreover, the term "sealing mechanism" includes: packers, bridge plugs, downhole valves, sliding sleeves, baffle-plug combinations, polished bore receptacle (PBR) seals, and other methods and devices for blocking the flow of fluids through the wellbore.

Techniques are disclosed herein for purposes of installing and using a fluid communication control device in a tubing string of a well completion. More specifically, techniques and systems are disclosed herein for installing an assembly that includes a flow control device, such as a sliding sleeve-type valve (as a non-limiting example), inside a screen assembly of a well completion for purposes of regulating fluid communication between a central passageway of the screen assembly and an annular region outside of the assembly. It is noted that the regulated flow may be a production flow or an injection flow, depending on the particular implementation. For purposes of clarifying the following discussion, it is assumed that the regulated flow is a production flow, although the techniques and systems that are disclosed herein may likewise be applied to injection systems, as can be appreciated by the skilled artisan.

One way to install a flow control device in a screen assembly is to install the flow control device as part of a sleeve valve that, in turn, forms a segment, or sub, of a base pipe. In this manner, the "base pipe" refers to the inner pipe of the sleeve valve, which defines the central passageway of the valve and thus, defines part of the overall tubing string that contains the sleeve valve. The base pipe may contain both radial ports (inflow control devices (ICDs)) for inflow communication as well as a sliding sleeve that is disposed inside the ICDs for purposes of allowing the selective regulation of flow through the ICDs. With this approach, the wall thickness of the sub may be relatively large as compared to the thickness of other regions of the base pipe to accommodate the relatively high flow rate through the ICDs, as the thickness imparts sufficient mechanical strength to the base pipe. Moreover, with this approach, relatively expensive threaded connections may be used for purposes of coupling the sub inline with the adjacent segments of the base pipe.

In accordance with example systems and techniques that are disclosed herein, a flow control assembly and more particularly, a sliding sleeve-based flow control assembly, is inserted and installed inside a base pipe, instead of being installed as a inline section, or sub, of the base pipe. With such an arrangement, relatively expensive threaded connections may be avoided.

Referring to FIG. 1, as a more specific example, a well system 10 in accordance with example implementations that are disclosed herein includes a tubing string 30 that extends into a wellbore 12. The wellbore 12, in turn, extends through one or more hydrocarbon-bearing formations that contain a hydrocarbon-based fluid, such as oil or gas. The wellbore 12 may be at least partially cased by a casing string, such as example casing string 20 that is depicted in FIG. 1; or in further implementations, the wellbore 12 may be uncased.

As depicted in the example of FIG. 1, the wellbore 12 includes a cased segment 12-1, which extends from the Earth surface downhole; and an uncased segment 12-2, which extends from the cased segment 12-1 further downhole into one or more production zones. It is noted that although the wellbore 12 is depicted in FIG. 1 as being formed from a vertical segment that extends into a lateral segment, the wellbore 12 may have other orientations or configurations, in accordance with further implementations. In general, the well system 10 may be a used in land-based, or subterranean, terrestrial well, or in a subsea well, depending on the particular implementation. Thus, many variations are contemplated, which are within the scope of the appended claims.

For the example that is depicted in FIG. 1, the tubing string 30 extends into the wellbore segments 12-1 and 12-2. Inside the lower wellbore segment 12-2, the tubing string 30 includes N screen assemblies (screen assemblies 40-1, 40-2 . . . 40-N-1, 40-N, being depicted in FIG. 1 as examples). It is noted that the tubing string 30 may have a single or multiple screen assemblies 40, depending on the particular implementation.

In general, in accordance with example implementations, each screen assembly 40 may be associated with a particular segment, or zone, of the wellbore 12 and includes a screen 44 that generally circumscribes a base pipe 46 of the assembly 40 for purposes of preventing the production of particulates (called "sand") into a central passageway 32 of the tubing string 30. For purposes of regulating the inflow in a given zone, the screen assembly 40 includes a sliding sleeve-based flow control assembly. More specifically, in accordance with example implementations, which are disclosed herein, one or more LCDs are installed in a given screen assembly 40 as part of the fluid communication control interface assembly 48, which is inserted into the central passageway 32 of the tubing string 30. Due to the fluid communication control interface assembly 48 being disposed inside the base pipe 46 (i.e., inside the wall of the tubing string 30), the base pipe 46 is the load carrying element of the assembly 48, i.e., transfers the longitudinally-applied forces of the tubing string 30.

In general, as further disclosed below, the fluid communication control interface assembly 48 may be secured to the base pipe 46 using any of a number of mountings, as can appreciated by the skilled artisan, such as a mounting via glue, a welded connection, a threaded fastener (a bolt, for example), a wedge, and so forth. Fluid communication through the fluid communication control interface assembly 48 may be adjusted for purposes of regulating production or injection by, for example, operating the assembly 48 using a tool (a shifting tool, for example), which is run downhole inside the central passageway 32 of the tubing string 30. In further implementations, the fluid communication control interface assembly 48 may be operated using wireless (optical, acoustic, electromagnetic signaling, for example) or wired communications as well as may be operated using a tool other than a shifting tool. Thus, many variations are contemplated, which are within the scope of the appended claims.

Figure 2:
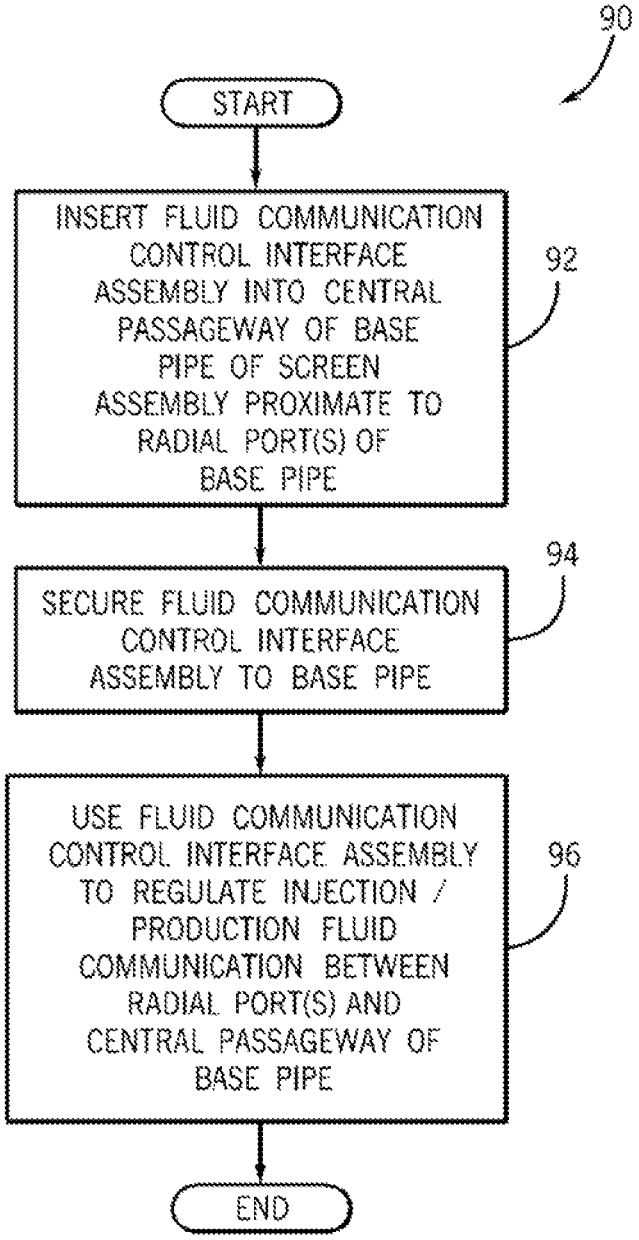
FIG. 2 is a flow diagram depicting a technique to assemble and use a fluid communication control assembly of the system of FIG. 1 according to an example implementation.

Thus, referring to FIG. 2, in accordance with example implementations, a technique 90 includes inserting (block 92) a fluid communication control interface assembly into a central passageway of a base pipe of a screen assembly proximate to one or more radial ports of the base pipe and securing (block 94) the fluid communication control interface assembly to the base pipe. The fluid communication control interface assembly may then be used to regulate injection/production fluid communication between the radial port(s) and the central passageway of the base pipe, pursuant to block 96.

Figure 3:
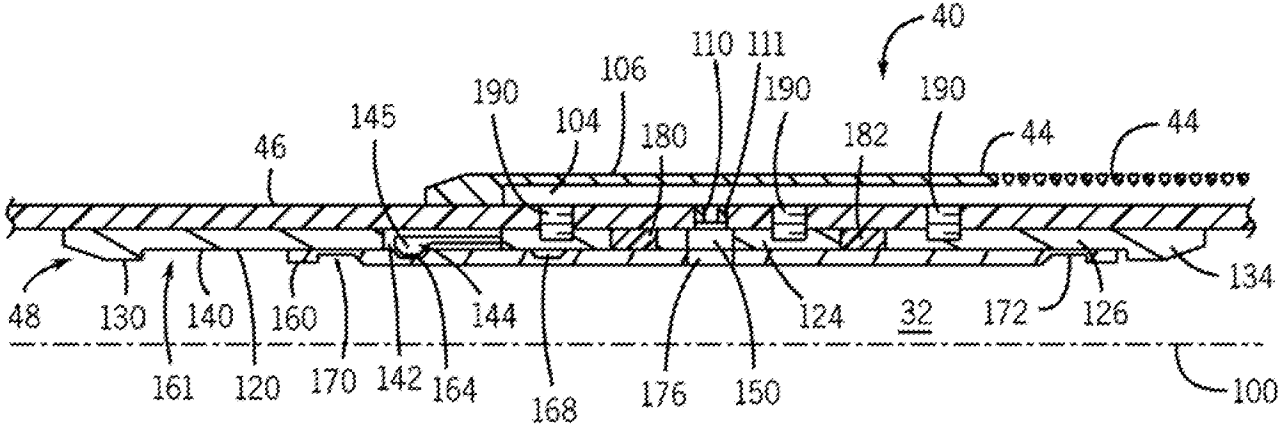
FIG. 3 is a partial cross-sectional view of the fluid communication control assembly in an open position taken along line 3-3 of FIG. 1 according to an example implementation.

As a more specific example, FIG. 3 depicts a partial cross-sectional view (taken along line 3-3 of FIG. 1) of the fluid communication control interface assembly 48 according to an example implementation. In general, the fluid communication control interface assembly 48 is concentric with a local, longitudinal axis 100 of the tubing string 30. Therefore, in the schematic view depicted in FIG. 3 and in the subsequent figures, it is understood that fluid communication control interface assembly 48 is generally symmetrical about the longitudinal axis 100, although one half of the cross-sectional view is depicted in these figures.

In general, for the example implementation that is depicted in FIG. 3, the fluid communication control interface assembly 48 is a sliding sleeve-based assembly that includes a slidable sleeve 160 to control fluid communication through the ICDs (radial nozzles, or ports 110, for the depicted example implementation). More specifically, the slidable sleeve 160 is mounted to the interface 161, and the interface forms a rigid connection with the base pipe 46 of the screen assembly 40.

For the example that is depicted in FIG. 3, the interface 161 includes three separate, generally concentric sections 120, 124 and 126, which are anchored, or mounted, for this example by threaded fasteners 190 (bolts, for example) to the base pipe 46. It is noted that although the cross-sectional view of FIG. 3 depicts three fasteners 190 (one per section 120, 124 and 126), more than one fastener 190 may be employed to secure a given section 102, 124, 126 to base pipe 46. The sections 120, 124 and 126 are referred to herein as the upper, intermediate and lower sections, respectively, which correspond to the relative positions of the sections 120, 124 and 126 in the well. In this manner, as a non-limiting example, the interface 161 may be installed by first installing the lowest section 126 inside the central passageway 32 of the base pipe 46 and thereafter installing the intermediate 124 and upper 120 sections (in this order).

The upper section 120, as depicted in FIG. 3, includes a releasable latch, such as a latch that is formed from a collet 144 that has collet fingers 145 (one collet finger 145 being depicted in FIG. 3), to form a releasable connection with the sleeve 160 for purposes of establishing different operating positions for the sleeve 160. In this manner, for the example that is depicted in FIG. 3, radial ports 176 (one radial port 176 being depicted in FIG. 3) of the sleeve 160 are aligned with radial ports 150 (one radial port 150 being depicted in FIG. 3) of the intermediate section 124 and are also aligned with corresponding radial nozzles, or ports 110, of the base pipe 46. In other words, for the example depicted in FIG. 3, the sleeve 160 is in a position that establishes an open position for the fluid communication control interface assembly 48 to permit fluid flow between the region outside of the screen and the central passageway 32. To releasably latch, or lock, the sleeve 160 in the open position, the fingers 145 of the collet 144 engage corresponding outer profiles 164 (a notch, for example) of the sleeve 160. Thus, in this releasably locked open position, a fluid flow may be communicated through the screen 44 of the screen assembly 40; into an annular region 104 between the screen 44 and the exterior surface of the base pipe 46; and through the radial ports 110, 150 and 176 into the central passageway 32 of the tubing string 30.

In accordance with some implementations, the radial ports 110 may have flow rates that are established by nozzle inserts 111. Thus, the number of the radial ports 110 and the nozzle size may be selected to select the flow rate for the particular application.

As depicted in FIG. 3, in accordance with an example implementation, the fluid communication control interface assembly 48 may be generally disposed near the upstream end of the screen assembly 40. In this manner, as shown in FIG. 3, a screen connection collar 106 may be attached (welded, for example) to the outer surface of the base pipe 46 and may also be connected to the lower end of the screen 44. In accordance with an example implementation, the sleeve 160 resides within a corresponding radially recessed region 140 of the interface 161, and the region 140 is formed by adjoining corresponding radially recessed regions of the sections 120, 124 and 126. End caps 130 and 134 on the interface sections 120 and 126, respectively, provide end stops (i.e., the boundaries) for the sliding sleeve 160 for purposes of confining the longitudinal travel of the sleeve 160.

The fluid communication control interface assembly 48 further includes seal elements 180 and 182 that straddle the radial ports 150. The seal element 180, 182 forms two fluid seals: a first fluid seal between the interface 161 and the sleeve 160; and a second fluid seal between the interface 161 and the interior surface of the base pipe 46. The seal element 180 is longitudinally disposed between the sections 120 and 124; and the seal element 182 is longitudinally disposed between the sections 124 and 126. As a non-limiting example, the seal element 180, 182 may be a ring-type seal and may be formed from an elastomer or another sealing material, as can be appreciated by the skilled artisan.

Because the interface 161 is formed from separate components, the components may be installed separately inside the base pipe 46, which permits the seals 180 and 182 to be installed in unenergized states (i.e., uncompressed to form their corresponding expanded-state seals) when the seal elements 180 and 182 are being inserted into the base pipe 46 during their installation. In this manner, as a non-limiting example, the components of the fluid communication control interface assembly 48 may be generally installed in the following order: the section 126 is first inserted into the base pipe 46 and secured via one or more threaded fasteners 190 to the base pipe 46; subsequently, the seal element 182 is inserted in its unenergized state into the central passageway of the base pipe 46; next, the interface section 124 is installed in the base pipe 46; the seal element 180 is then installed in its unenergized state into the base pipe 46; and lastly, the sleeve 160 and interface section 120 are installed into the central passageway of the base pipe 46. A force may be applied to force the upper 120 and intermediate 124 sections toward the lower section 126 for purposes of energizing the seal elements 180 and 182. With the seal elements 180 and 182 in their energized states, threaded fasteners 190 may be installed to secure the sections 120 and 124 in place. Other sequences may be employed for purposes of installing the components of the fluid communication control interface assembly 48, in accordance with other implementations. Thus, many variations are contemplated, which are within the scope of the appended claims.

Figure 4:
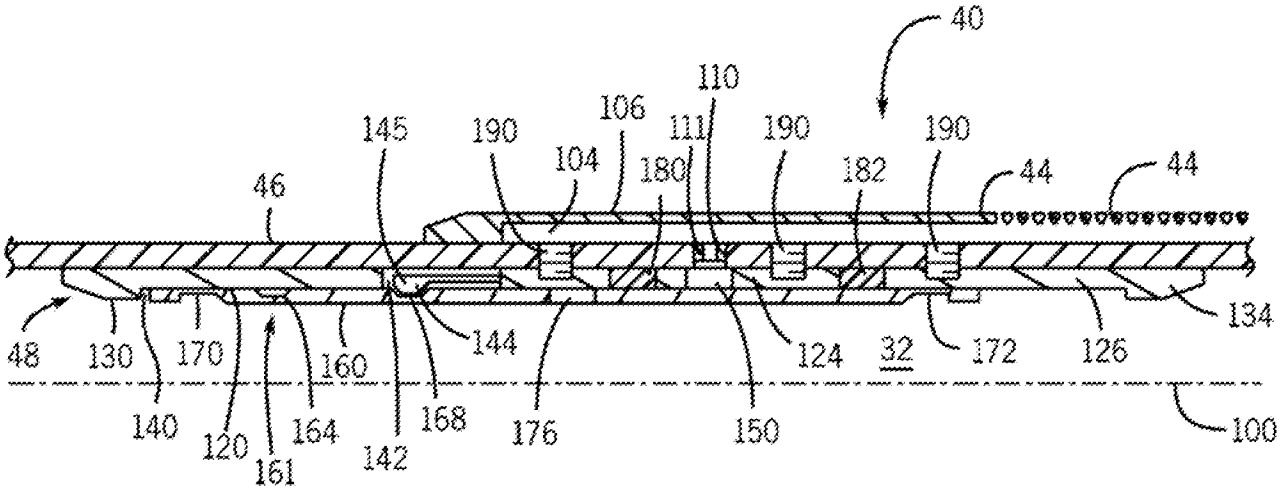
FIG. 4 is a partial cross-sectional view of the fluid communication control assembly of FIG. 3 in a closed position according to an example implementation.

FIG. 4 generally depicts the fluid communication control interface assembly 48 in its closed state. For this state, the sleeve 160 has been longitudinally translated along the longitudinal axis 100 to position the sleeve 160 such that the radial ports 176 of the sleeve 160 are no longer aligned with the radial ports 150 and 110. Thus, for the position of the sleeve 160, which is depicted in FIG. 4, fluid communication is blocked between the annular region 104 and the central passageway 32 of the tubing string 30; and the seal elements 180 and 182 provide the corresponding fluid seals to achieve the isolation.

In the position of the sleeve 160 that is depicted in FIG. 4, the sleeve 160 has been longitudinally translated such that an exterior annular profile 168 of the sleeve 160 is engaged by the fingers 145 of the collet 144, thereby releasably securing the sleeve 160 in the closed position. Translation of the sleeve 160 between the opened and closed positions may occur using one of a plurality of different mechanisms, depending on the particular implementation. More specifically, for example implementations disclosed herein, the sleeve 160 includes at least one interior profile for purposes of engaging a mating profile of a shifting tool (not shown), which may be run inside the central passageway 32 of the tubing string 30 for this purpose. More specifically, in an example implementation, the sleeve 160 includes a first interior profile 170 for purposes of engaging a corresponding profile of the shifting tool to longitudinally translate the sleeve 160 from the open position (depicted in FIG. 3) to the closed position (depicted in FIG. 4). The sleeve 160 further includes another interior profile 172 for purposes of, for example, engaging a corresponding profile on the shifting tool to longitudinally translate the sleeve 160 from the closed position (FIG. 4) to the open position (FIG. 3).

It is noted that other tools other than shifting tools may be employed for purposes of translating the position of the sleeve 160, in accordance with other implementations. Moreover, the sleeve 160 may have a single shifting profile, may have more than two shifting profiles and may have profiles other than those depicted in FIGS. 3 and 4, in accordance with further implementations. Moreover, in accordance with further implementations, the fluid communication control interface assembly may have more than two states. For example, in accordance with further implementations, the sleeve may be set to a plurality of open positions, associated with different inflow rates, and as such, the fluid communication control interface assembly may be an adjustable choke. Thus, many variations are contemplated, which are within the scope of the appended claims.

Figure 5:
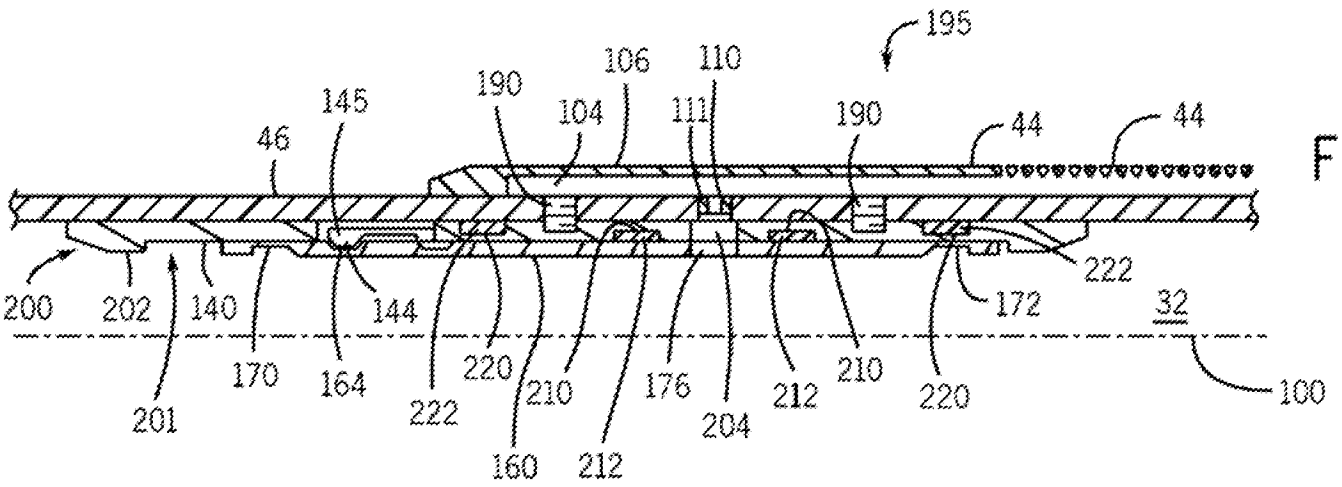
FIG. 5 is a partial cross-sectional view of a fluid communication control assembly in an open position according to a further example implementation.

In a further implementation, a screen assembly 195 that is depicted in FIG. 5 may be used in place of the screen assembly 40 (see FIGS. 3 and 4). Referring to FIG. 5, in general, the screen assembly 195 has a fluid communication control assembly 200 that replaces the fluid communication control assembly 48 of the screen assembly 40. It is noted that in FIG. 5, similar reference numerals have been used to denote similar elements of the fluid communication control interface assemblies 48 and 200, with different reference numerals being used in FIG. 5 to refer to features that are not shared in common. For the fluid control communication interface assembly 200, an interface 201 (replacing the interface 161 of the assembly 48) is a single unit. In this manner, the interface 201 includes exterior channels 222 to receive seal elements 220 to form corresponding fluid seals between the interface 201 and the interior surface of the base pipe 46; and interior channels 210 to receive seal elements 212 to form corresponding fluid seals between the interface 201 and the exterior surface of the sleeve 160. Therefore, for this implementation, the seal elements 212 and 220 may be installed inside the base pipe 46 with the single interface and the sleeve 160 as a unit.

It is noted that it may be relatively challenging to install the fluid communication control interface assembly 200 as a single unit with the seal elements, as American Petroleum Institute (API) grade tubing may be used for the base pipe 46 and may have a relatively rough and relatively uneven interior surface. Therefore, in accordance with further implementations, the seal elements 212 and 220 may be formed from such materials as swellable elastomeric material, a curable material such as thermoset or cement, and so forth, which permit the seal elements 212 and 220 to be installed in unenergized states as part of the interface 201.

Figure 6:
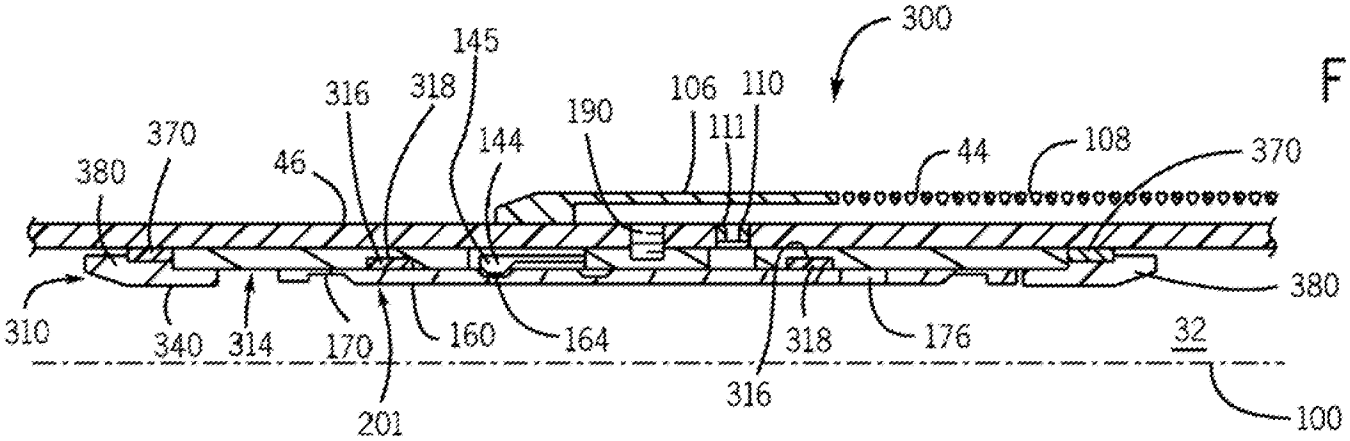
FIG. 6 is a partial cross-sectional view of a fluid communication control assembly in a closed position according to a further example implementation.

Referring to FIG. 6, in accordance with further implementations, a fluid communication control interface 310 (part of a screen assembly 300) may be used in place of the fluid communication control interface assemblies 48 (see FIGS. 3 and 4) and 200 (see FIG. 5). To the extent that the fluid communication control interface assembly 310 shares similar features to the interfaces 48 and 200, common reference numerals are used in FIG. 6. The fluid communication control interface 310 includes seal elements 318, which are received in corresponding internal channels of an interface 314 (that replaces the interfaces 161 and 201), for purposes of forming corresponding fluid seals between the interface and the exterior surface of the sleeve 160. Unlike the fluid communication control interface assembly 200 (see FIG. 5), however, seal elements 370 form corresponding fluid seals between the interface 311 and the interior surface of the base pipe 46 and are disposed at the ends of the interface 314.

More specifically, as depicted in FIG. 6, the seal elements 370 are disposed at either end of the interface 314 and are secured in place by corresponding retainers, or end caps 380, which are connected (via threaded connections, for example) to the ends of the interface 314. In this regard, as shown in FIG. 6, the end cap 380 includes an exterior annular channel that receives the seal element 370 such that when the end cap 380 is further threaded onto the corresponding threaded connection of the end of the interface 314, the seal element 370 is compressed to thereby energize the seal element 370.

Thus, for this arrangement, the fluid communication control interface assembly 310 may be assembled in the following manner. First, one of the end caps 380 is deployed inside the central passageway 32; next, the integrated unit of the interface 314, the sleeve 160 and the seal elements 318, is deployed inside the central passageway 32. Next, this integrated unit is secured to the base pipe 46 via one or more threaded fasteners 190. Subsequently, the other seal element 370 is deployed into the central passageway 32, and lastly, the other end cap 380 is deployed inside the central passageway 32. Subsequently, the end caps 380 are threaded and tightened onto the interface 310 for purposes of energizing the corresponding seal elements 370. For this purpose, an installation tool may be employed that engages one or both end caps 380 and turns the end caps 380 in opposite rotational directions with respect to each other (as a non-limiting example). Thus threaded fasteners 190 secure the interface 310 to the base pipe 46.

Although the seal elements 370 are depicted in FIG. 6 as each having a constant radial diameter that seals against the corresponding end cap 380, the interior face of the seal element 370 may be inclined (may have a conical interior face, for example), an inclination which causes the seal element 370 to be compressed against the end cap 380 as the end cap 380 is further threaded onto the interface 314.

As noted above, the base pipe 46 may have a relatively unpolished, or rough inner surface. Moreover, the base pipe 46, as delivered, may have different wall thicknesses, resulting in a potentially varying inside diameter for the base pipe 46. To accommodate this variation, the inner diameter of the base pipe 46 may be drilled or otherwise machined to a larger diameter that is common for at least pipes with the same outer diameter. Moreover, the base pipe 46 may be machined from one end into the desired location of the sleeve 160, which makes it relatively easier to install the fluid communication control interface assembly 310 and also facilitates selection of a reliable seal solution, particularly if the seal elements are pre-installed before the assembly 310 is inserted into the base pipe 46.

The interior surface of the base pipe 46 may also be machined locally in the general vicinity of the interface to improve seal properties and also for purposes of removing any ovality, which may occur inside the base pipe 46. Furthermore, one or more channels, or grooves, may be machined into the interior surface of the base pipe 46 to provide a locking mechanism and further improve the sealing surface.

Figure 7:
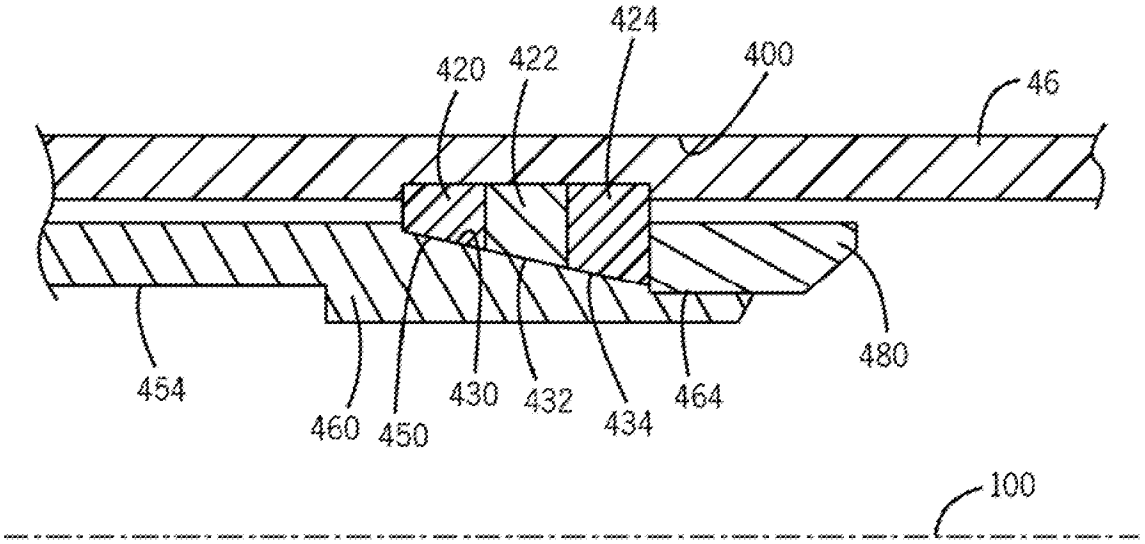
FIG. 7 is a cross-sectional view of an end portion of the fluid communication control assembly according to a further example implementation.

More specifically, referring to FIG. 7, in accordance with some embodiments, a channel, or groove 400 may be machined into the interior surface of the base pipe 46, which receives a seal element 42 as well as c-rings 420 and 424 (disposed on either side of the seal element 422). As shown in FIG. 7, the c-rings 420 and 424, as well as the seal element 422 have respective inclined faces 450, 434 and 432, respectively (conical faces, for example), which mate with a corresponding inclined face 450 of an end portion 460 of a fluid communication control interface assembly 454. The distal end 464 of the fluid communication control interface assembly 454, in turn, includes threads (for this example) to mate with corresponding threads of an end cap 480, as depicted in FIG. 7. Therefore, when the end cap 480 is threaded onto the end 464 of the interface 454, the seal element 422 is compressed between the c-rings 420 and 424 for purposes of energizing the seal element 422.

While a limited number of examples have been disclosed herein, those skilled in the art, having the benefit of this disclosure, will appreciate numerous modifications and variations therefrom. It is intended that the appended claims cover such modifications and variations.

What is claimed:

1. An apparatus comprising:

a base pipe comprising at least one radial port;

a screen to at least partially circumscribe the base pipe to create a flow path between a first region outside of the screen and a second region inside the base pipe, the flow path comprising the at least one radial port of the base pipe and a third region between the screen and the exterior of the base pipe; and a first assembly to regulate fluid communication along the flow path, the first assembly being disposed wholly within the base pipe and comprising:

a second assembly disposed in and mounted to the base pipe by a fastener, the second assembly being at a fixed position with respect to the base pipe and having at least one port to enable fluid communication along the flow path; and a flow control device adapted to regulate the fluid communication through the flow path, the flow control device comprising a sleeve slidably connected to the second assembly, the sleeve being adapted to translate between at least two positions while remaining slidably connected to the second assembly to regulate the fluid communication along the flow path.

2. The apparatus of claim 1, wherein the flow control device is adapted to be shifted between an open position in which fluid communication occurs through the flow path and a closed position in which no fluid communication occurs through the flow path.

3. The apparatus of claim 1, wherein the flow control device is adapted to be shifted between a first position associated with a first flow configuration and a second position associated with a second flow configuration.

4. The apparatus of claim 3, wherein the first flow configuration comprises a first set of radial ports associated with the fluid communication and the second flow configuration comprises a second set of radial ports associated with the fluid communication, the second set of radial ports being different from the first set of radial ports.

5. The apparatus of claim 1, wherein the flow path is selected from a group consisting essentially of a production flow path to communicate fluid from the first region outside of the screen to the second region inside the base pipe, and an injection flow path to communicate fluid from the second region inside the base pipe to the first region outside of the screen.

6. The apparatus of claim 1, wherein the second assembly comprises at least one seal to form fluid a first fluid seal between the second assembly and the base pipe and a second fluid seal between the second assembly and the flow control device.

7. The apparatus of claim 1, wherein the second assembly comprises a releasable latch to releasably retain the flow control device in a selected position associated with a selected flow through the device.

8. The apparatus of claim 7, wherein the releasable latch comprises a collet adapted to releasably engage a profile of the flow control device.

9. The apparatus of claim 1, wherein the second assembly comprises a plurality of annular segments and at least one seal, wherein the plurality of annular segments are adapted to be deployed inside the base pipe according to an assembly sequence and the at least one seal is adapted to be disposed according to the sequence between two of annular segments.

10. The apparatus of claim 1, wherein the fastener comprises at least one threaded fastener to radially extend between the base pipe and the second assembly to secure the second assembly to the base pipe.

11. The apparatus of claim 1, wherein:

the second assembly comprises a radially recessed region to receive the sleeve; and the sleeve is adapted to translate in the radially recessed region between at least two positions associated with different flow control states of the flow control device.

12. The apparatus of claim 11, wherein:

the sleeve comprises at least one inner profile exposed on an interior surface of the sleeve; and the inner profile being adapted to engage a shifting tool to translate the sleeve between the two positions.

13. The apparatus of claim 1, wherein the base pipe is adapted to primarily carry a longitudinal load applied to the apparatus relative to the first assembly.

14. The apparatus of claim 1, wherein the second assembly comprises an annular segment comprising at least a first radially recessed region to receive a first seal element to form a seal between the annular segment and the base pipe and at least a second radially recessed region to receive a second seal element to form a seal between the annular segment and the flow control device.

15. The apparatus of claim 1, wherein the second assembly comprises:

an annular segment comprising at least one radially recessed region to receive a first seal element to form a seal between the annular segment;

a second seal element to form a seal between the annular segment and the base pipe, wherein the second seal element is adapted to be deployed inside the base pipe after the annular segment is deployed inside the base pipe; and a retainer to be deployed inside the base pipe after deployment of the second seal element to form a connection with the annular segment to energize the second seal element.

16. The apparatus of claim 15, wherein the retainer and the annular segment are adapted to form a threaded connection adapted to be tightened to energize the second seal element.

17. The apparatus of claim 15, wherein the second seal element comprises an inclined face adapted to energize the second seal element in response to a force acting on the inclined face due to the connection of the end cap with the annular segment.

18. The apparatus of claim 15, wherein the base pipe comprises a recessed region to receive the second seal element.

19. The apparatus of claim 15, further comprising at least one c-ring adapted to be received in the recessed region of the base pipe.

20. A method usable with a well, comprising:

inserting a fluid communication control interface into a central passageway of a base pipe of a screen assembly proximate to at least one radial port of the base pipe until the fluid communication control interface is installed inside the base pipe such that the base pipe surrounds the fluid communication control interface;

securing the fluid communication control interface to the base pipe; and slidably mounting a sleeve to the fluid communication control interface on an opposite radial side of the fluid communication control interface relative to the base pipe such that the sleeve may be slid between positions to regulate fluid communication between the at least one radial port and the central passageway of the base pipe.

21. The method of claim 20, further comprising:

providing a latch of the interface to releasably hold the sleeve in at least one of two positions.

22. The method of claim 20, wherein inserting the fluid communication control interface comprises: deploying longitudinal segments of the interface in the central passageway in a sequence; and deploying at least one fluid seal between two of the longitudinal segments.

23. The method of claim 20, wherein inserting the fluid communication control interface comprises:

deploying the interface with the sleeve as a unit in the central passageway of the base pipe; and subsequent to the deployment of the interface, deploying a seal element to form a seal between the sleeve and the base pipe.

24. The method of claim 20, further comprising deploying a retainer in the central passageway and forming a connection between the retainer and the interface to energize the seal.

25. An system usable with a well, comprising:

a tubing string to communicate fluid between an Earth surface and a downhole annular region, the tubing string comprising at least one screen assembly comprising:

a base pipe comprising at least one radial port;

a screen to at least partially circumscribe the base pipe and be positioned downhole to create the annular region, the screen being adapted to communicate fluid in a flow path between the annular region and a second region inside the base pipe, the flow path comprising the at least one radial port of the base pipe and a third region between the screen and the exterior of the base pipe; and a first assembly to regulate fluid communication along the flow path, the first assembly being disposed wholly within the base pipe and comprising:

a second assembly disposed in and mounted to the base pipe by a fastener, the second assembly being at a fixed position with respect to the base pipe and having at least one port to enable fluid communication along the flow path; and a sleeve slidably connected to the second assembly, the sleeve being adapted to be translated by a tool run downhole inside the tubing string between at least two positions while remaining slidably connected to the second assembly to regulate the fluid communication through the flow path.

* * * * *